US006425461B1

(12) United States Patent
Wang

(10) Patent No.: US 6,425,461 B1
(45) Date of Patent: Jul. 30, 2002

(54) DOUBLE BACKUP POWER FOR ELEVATOR

(76) Inventor: Chiu Nan Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 09/908,075

(22) Filed: Jul. 17, 2001

(51) Int. Cl.[7] ..... B66B 1/06
(52) U.S. Cl. ..... 187/290
(58) Field of Search ..... 187/290, 296, 187/297, 277, 413, 414; 307/64, 65, 66

(56) References Cited

U.S. PATENT DOCUMENTS

| | | | | | |
|---|---|---|---|---|---|
| 4,506,766 | A | * | 3/1985 | Watanabe | 187/290 |
| 4,894,765 | A | * | 1/1990 | Kahkipuro | 307/20 |
| 5,580,207 | A | * | 12/1996 | Kiebooms et al. | 180/19.2 |
| 5,693,919 | A | * | 12/1997 | Sager et al. | 187/282 |
| 6,039,151 | A | * | 3/2000 | Ringel et al. | 187/207 |
| 6,315,081 | B1 | * | 11/2001 | Yeo | 187/290 |

FOREIGN PATENT DOCUMENTS

| | | | | |
|---|---|---|---|---|
| JP | 07196269 A | * | 8/1995 | B66B/5/02 |
| JP | 08319072 A | * | 12/1996 | B66B/5/02 |
| JP | 11322217 A | * | 11/1999 | B66B/5/02 |

* cited by examiner

*Primary Examiner*—Jonathan Salata
(74) *Attorney, Agent, or Firm*—Pro-Techtor International Services

(57) ABSTRACT

A double backup power device for an elevator including a motor; a control within a car of the elevator, the control including a startup button, an up button, and a down button; and a backup power assembly including a primary battery, a secondary battery, an electrolytic container in fluid communication with the secondary battery, a check valve on the electrolytic container for controlling a flow of the electrolyte, and a switch in a series connection with the primary and the secondary batteries which are parallel connected to the motor means. When the car is disabled, one of persons trapped in the car is permitted to press the startup button to activate the backup power assembly; the switch is dosed for electrically interconnecting the primary and the secondary batteries and for activating the motor means; the check valve is open for permitting the electrolyte to continuously drop from the electrolytic container to the secondary battery for charging; and the up or the down button is operative to carry the car to one of a predetermined locations for evacuating persons. The device will work as long as at least one of the primary and the secondary batteries is normal.

2 Claims, 5 Drawing Sheets

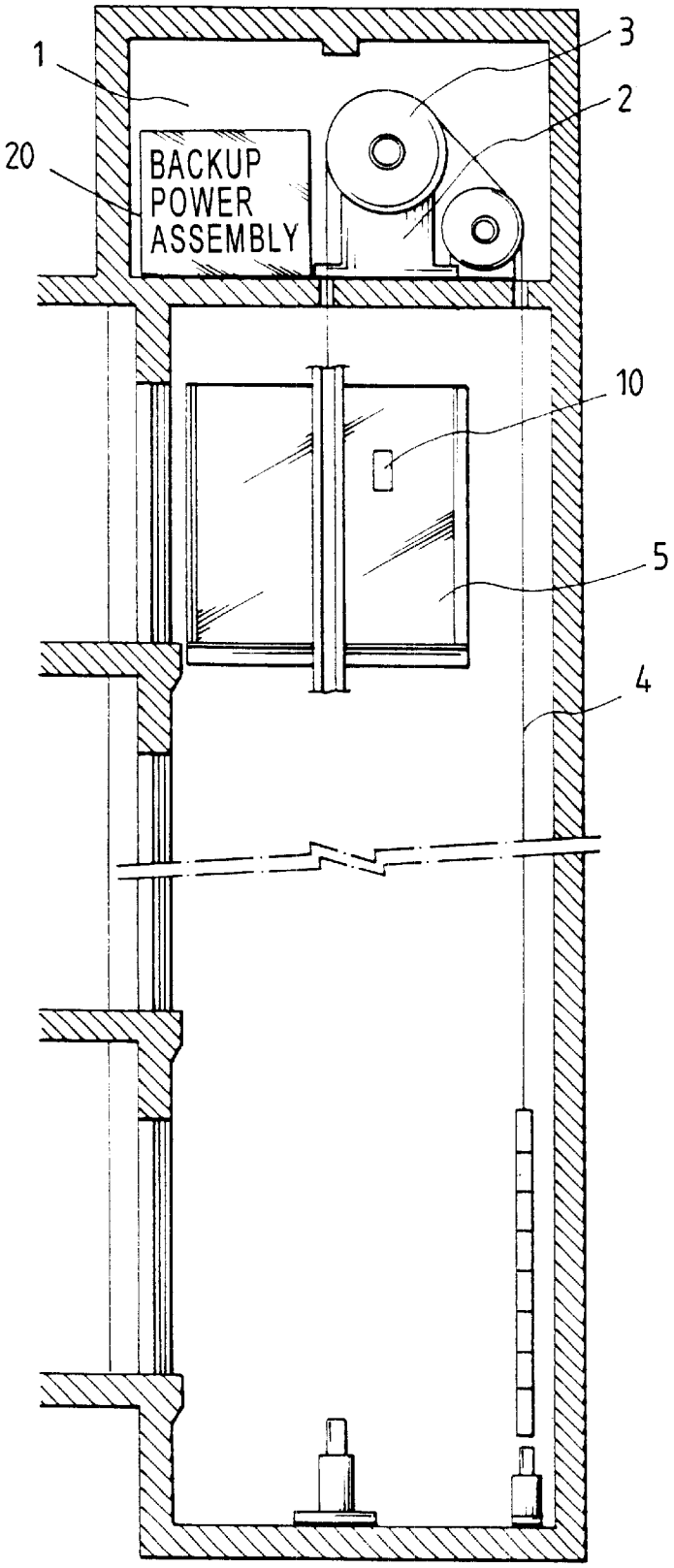
FIG, 1

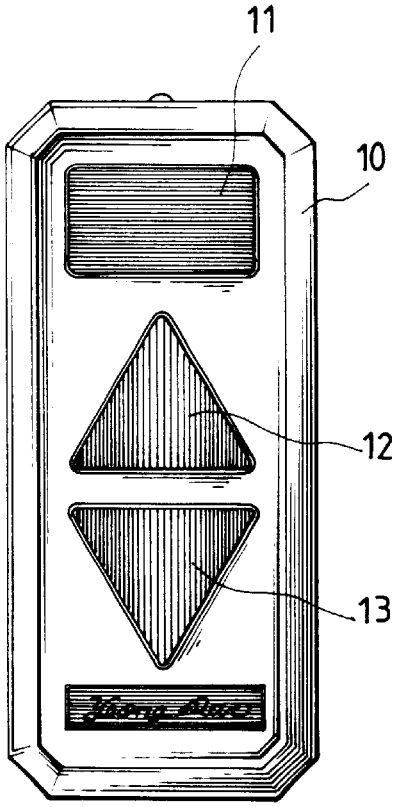
FIG, 2
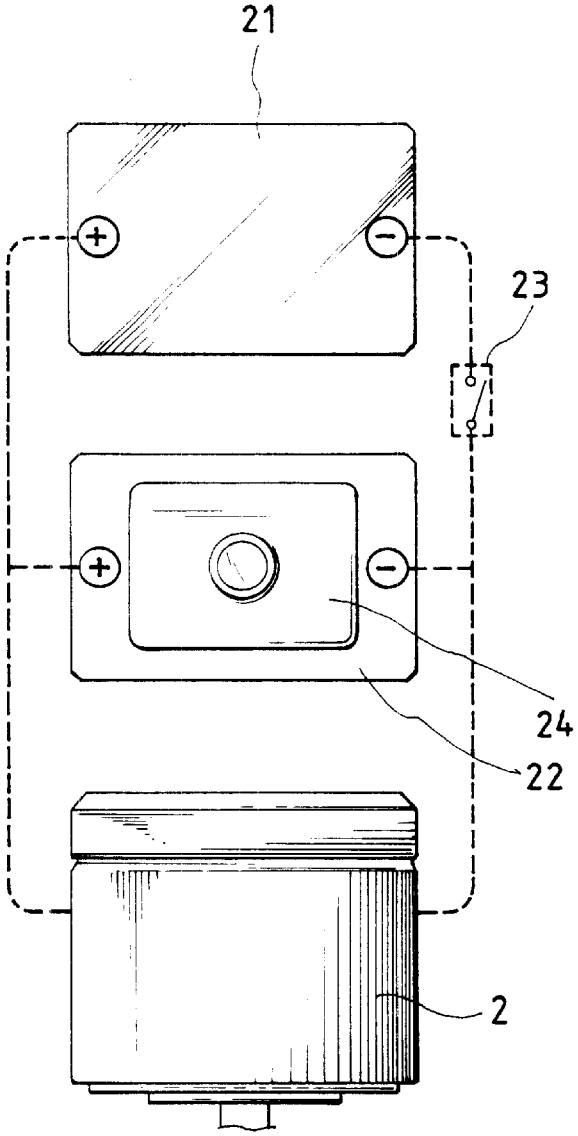
FIG, 3

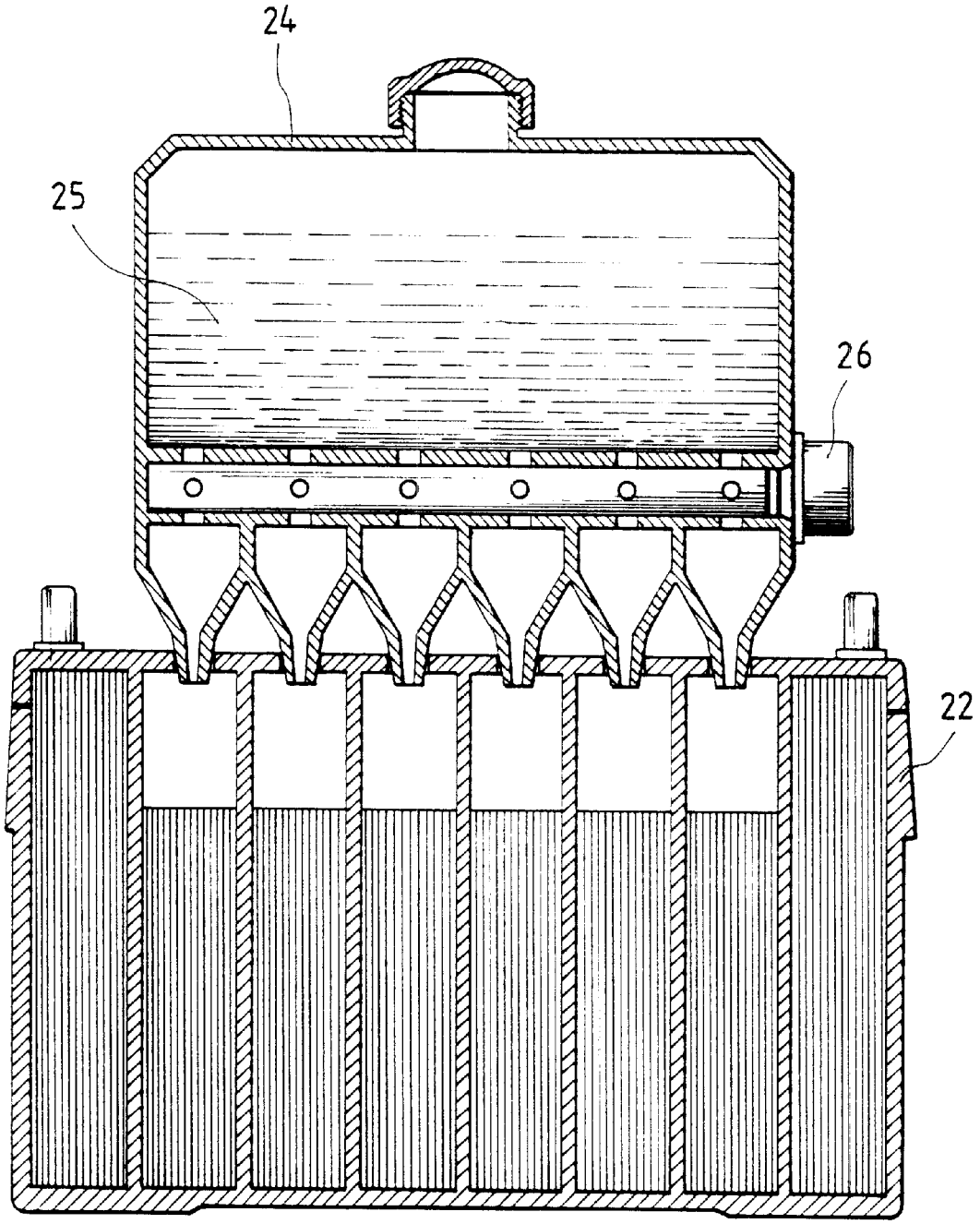
FIG, 4

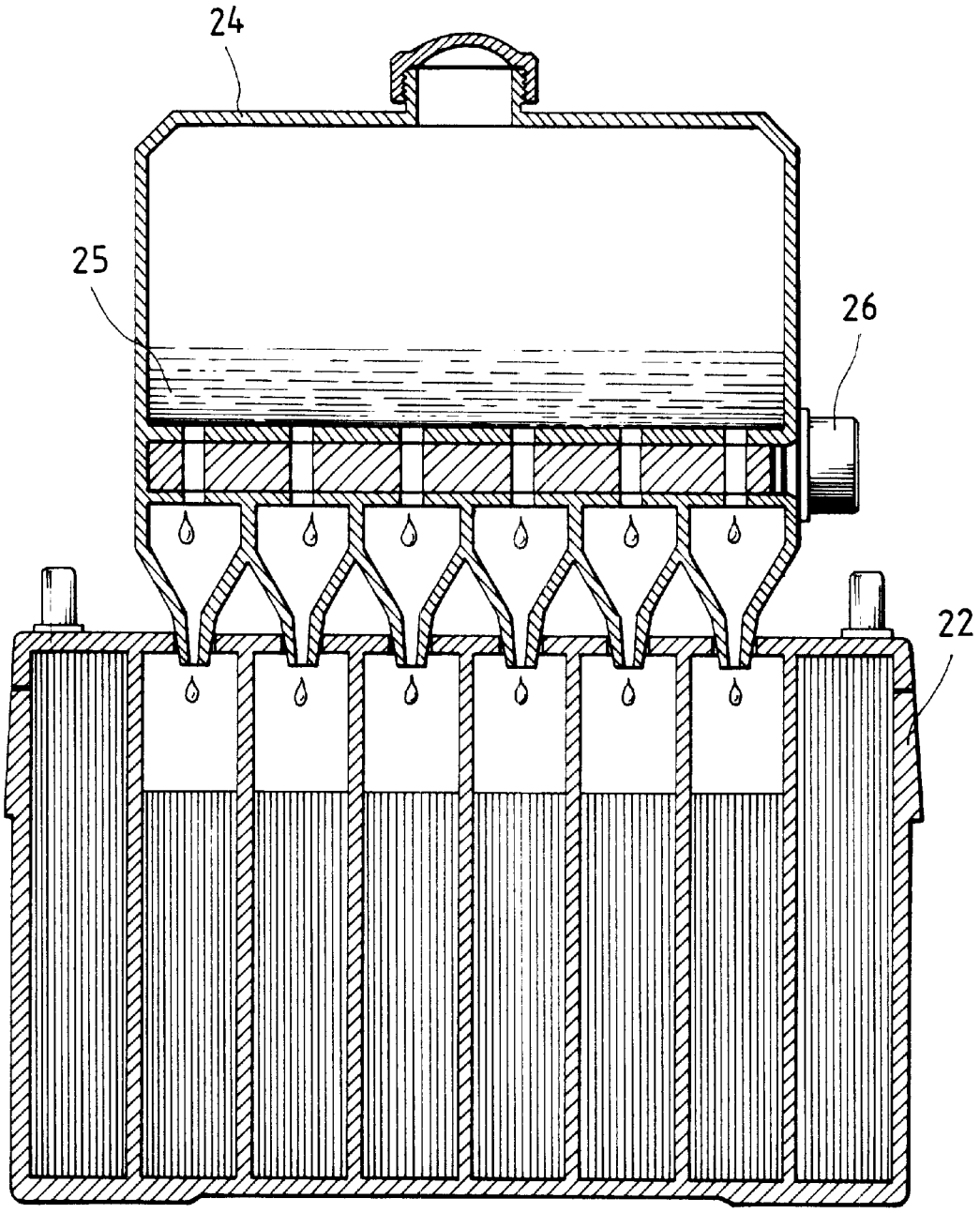
FIG, 5

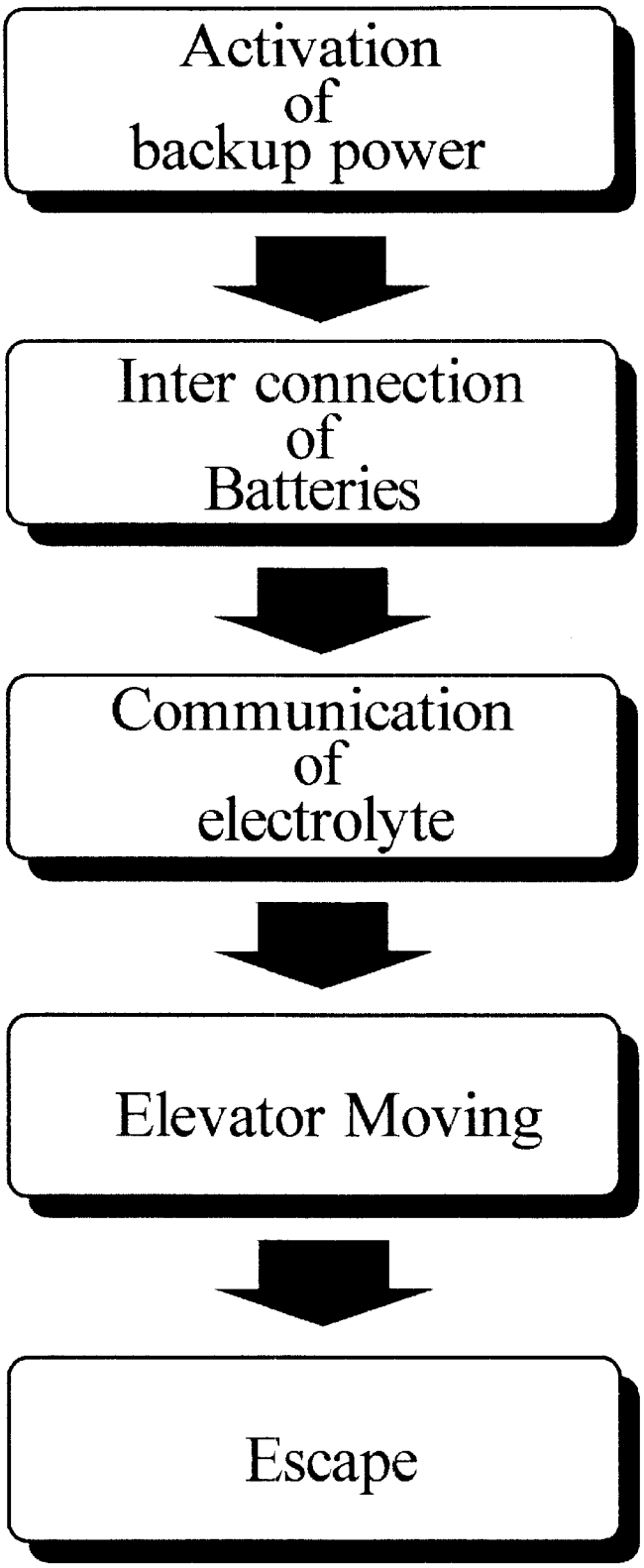
FIG, 6

DOUBLE BACKUP POWER FOR ELEVATOR

FIELD OF THE INVENTION

The present invention relates to backup systems and more particularly to an improved double backup power for elevator.

BACKGROUND OF THE INVENTION

Backup power system for elevator is well known. Typically, a backup motor will be activated in a short period of time after a power out occurs for supplying power to an elevator. The drawback of such backup power system is that there is a still possibility of the system failure when such power out occurs. Further, not all elevators are equipped with such emergency power. Another technique for helping people escape from an endangered car of elevator is to install a mechanical life saying device associated with elevator. The drawbacks of such device are that it requires user practice. Otherwise, it may not work well in an emergency. Different mechanical life saving devices may have different respective operation procedures. Hence, a user is familiar with one life saving device may not be familiar with the other one. In view of above, prior art is unsatisfactory for the purpose for which the invention is concerned. Thus, it is desirable to provide an improved backup power for elevator in order to overcome the above drawbacks of prior art.

SUMMARY OF THE INVENTION

It is therefore an object of the present invention to provide a double backup power device for an elevator comprising motor means; a control within a car of the elevator, the control comprising a startup button, an up button, and a down button; and a backup power assembly comprising a primary battery, a secondary battery, an electrolytic container for storing an electrolyte being disposed above and in fluid communication with the secondary battery, a check valve on the electrolytic container for controlling a flow of the electrolyte, and a switch in a series connection with the primary and the secondary batteries which are parallel connected to the motor means; and wherein when the car is disabled, one of persons trapped in the car is permitted to press the startup button to activate the backup power assembly; the switch is closed for electrically interconnecting the primary and the secondary batteries and for activating the motor means; the check valve is open for permitting the electrolyte to continuously drop from the electrolytic container to the secondary battery for charging; and the up or the down button is operative to carry the car to one of a predetermined locations for evacuating persons.

In one aspect of the present invention, the device acts normally as long as at least one of the primary and the secondary batteries has a sufficient electrical energy stored therein.

The above and other objects, features and advantages of the present invention will become apparent from the following detailed description taken with the accompanying drawings.

BRIEF DESCRIPTION OF THE DRAWINGS

FIG. 1 is a cross-sectional view of an elevator incorporating a preferred embodiment of double backup power device according to the invention;

FIG. 2 is a plan view of a control of FIG. 1;

FIG. 3 is top view schematically showing an electrical connection of motor and two batteries;

FIG. 4 is a cross-sectional view of electrolytic container and secondary battery;

FIG. 5 is a view similar to FIG. 4 where electrolyte is dropping to secondary battery when the double backup power device is activating in a power out condition; and FIG. 6 is a flow chart illustrating an operating process of the invention.

DETAILED DESCRIPTION OF THE PREFERRED EMBODIMENTS

Referring to FIGS. 1 to 4, there is shown an elevator incorporating a preferred embodiment of double backup power device constructed in accordance with the invention. The elevator comprises an upper control room 1 in which a motor 2, a drive sheave 3, and a backup power assembly 20 are provided; a lower channel having a car 5 and a control 10 within car 5, control 10 comprising a startup button 11, an 'up' button 12, and a 'down' button 13 (FIG. 2); and a travelling cable 4 interconnecting car 5 and drive sheave 3 for hoisting or lowering car 5 to one of a plurality of predetermined locations (e.g., respective levels of a building). Backup power assembly 20 comprises a primary battery 21, a secondary battery 22, an electrolytic container 24 for storing a sufficient amount of electrolyte 25 being disposed above and in fluid communication with secondary battery 22, a check valve 26 on a side of the case of electrolytic container 24 near the bottom for controlling the flow of electrolyte 25, and a switch 23 in a series connection with the primary and the secondary batteries 21 and 22 which are parallel connected to the motor 2.

Referring to FIGS. 5 and 6, an operating process of the invention will now be described. When an emergency occurs (such as power out), firstly one of persons trapped in the halted car 5 may push startup button 11 to activate the backup power system. Secondly, switch 23 is closed to electrically interconnect the primary and the secondary batteries 21 and 22 and to activate the motor 2. Thirdly, at the same time check valve 26 is open in response to the activation of switch 23 for permitting electrolyte 25 to continuously drop from electrolytic container 24 to secondary battery 22 for charging (FIG. 5). Fourthly, person may press 'up' button 12 or 'down' button 13 to hoist or lower car 5 to a nearest level. finally, persons may escape the trapped car 5 once the level is reached. Note that the double backup power device will function well as long as at least one of primary battery 21 and secondary battery 22 has a sufficient electrical energy stored therein.

While the invention has been described by means of specific embodiments, numerous modifications and variations could be made thereto by those skilled in the art without departing from the scope and spirit of the invention set forth in the claims.

What is claimed is:

1. A double backup power device for an elevator comprising:

motor means;

a control within a car of said elevator, said control comprising a startup button, an up button, and a down button; and a backup power assembly comprising a primary battery, a secondary battery, an electrolytic container for storing an electrolyte being disposed above and in fluid communication with said secondary battery, a check valve on said electrolytic container for controlling a flow of said electrolyte, and a switch in a series connection with said primary and said secondary batteries which are parallel connected to said motor means; and wherein when said car is disabled, one of persons trapped in said car is permitted to press said startup button to activate said backup power assembly; said switch is closed for electrically interconnecting said primary and said secondary batteries and for activating said motor means; said check valve is open for permitting said electrolyte to continuously drop from said electrolytic container to said secondary battery for charging; and said up or said down button is operative to carry said car to one of a predetermined locations for evacuating persons.

2. The device of claim 1, wherein said device acts normally as long as at least one of said primary and said secondary batteries has a sufficient electrical energy stored therein.

* * * * *